US007452288B2

(12) United States Patent
Nagasaki et al.

(10) Patent No.: US 7,452,288 B2
(45) Date of Patent: Nov. 18, 2008

(54) METHOD OF MANUFACTURING A GOLF BALL

(75) Inventors: Shunichi Nagasaki, Kobe (JP); Jun Yamakawa, Kobe (JP)

(73) Assignee: SRI Sports Ltd., Kobe-shi (JP)

( * ) Notice: Subject to any disclaimer, the term of this patent is extended or adjusted under 35 U.S.C. 154(b) by 212 days.

(21) Appl. No.: 11/055,075

(22) Filed: Feb. 11, 2005

(65) Prior Publication Data

US 2005/0215355 A1 Sep. 29, 2005

(30) Foreign Application Priority Data

Mar. 24, 2004 (JP) ..... 2004-087775

(51) Int. Cl.
*A63B 37/00* (2006.01)

(52) U.S. Cl. ..... 473/351

(58) Field of Classification Search ..... 473/351, 473/378

See application file for complete search history.

(56) References Cited

U.S. PATENT DOCUMENTS 2,805,072 A * 9/1957 Smith ..... 473/378
5,334,673 A 8/1994 Wu
5,857,925 A * 1/1999 Sullivan et al. ..... 473/374
6,251,991 B1 6/2001 Takesue et al.
6,384,135 B2 5/2002 Takesue et al.

FOREIGN PATENT DOCUMENTS

JP 5-269221 A 10/1993
JP 2002-65344 A 3/2002

* cited by examiner

*Primary Examiner*—Raeann Trimiew
(74) *Attorney, Agent, or Firm*—Birch, Stewart, Kolasch & Birch, LLP

(57) ABSTRACT

The present invention relates to a method of manufacturing a painted golf ball with reduced static electricity on the surface of the golf ball prior to painting to allow even painting to produce a ball without asperity on the surface, characterized by irradiating the surface of the golf ball, which is positively charged before painting, with negative ions directly before painting. Preferably, the surface of the golf ball after the irradiation with negative ions and prior to the painting is negatively charged, and particularly, the surface of the golf ball after the irradiation with negative ions prior to the painting is preferably charged at −0.1 to −40 kV.

11 Claims, 1 Drawing Sheet

METHOD OF MANUFACTURING A GOLF BALL

This nonprovisional application is based on Japanese Patent Application No. 2004-087775 filed with the Japan Patent Office on Mar. 24, 2004, the entire contents of which are hereby incorporated by reference.

BACKGROUND OF THE INVENTION

1. Field of the Invention

The present invention provides a method of manufacturing a painted golf ball with decreased static electricity on the surface of the golf ball prior to the painting to allow even painting to produce a ball without asperity thereon.

2. Description of the Background Art

Generally, a golf ball may be categorized in its structure as two types: a thread-wound ball and a solid ball. A thread-wound ball may be produced by extending rubber threads and winding them around a solid or liquid core and placing a cover around it. A solid ball may be formed by covering a hard-rubber core with one or more core outer layer(s) and a cover, and includes a one-piece ball, a two-piece ball or the like.

In any of these golf balls, the surface of the cover which forms the outermost layer is provided with a paint. The paint is generally formed of two layers: white and clear, and a clear paint layer provides the outermost surface. The paint layer is formed by a urethane resin paint.

There are a variety of property requirements for a paint, for example the toughness that enables a ball to resist large impact forces from the strike by a club face, and the flexibility that allows the ball to obey deformation caused by the impact. After the strike, when the ball falls onto the ground, it spins and is rubbed severely against turf, dirt, mud, gravel or the like, which causes decrease in shine due to wear, entrance of mud into the cuts, or adhesion of juice of the grass in the turf. In recent years, there is an increasing demand for a golf ball that retains its aesthetic appearance after use in terms of apparent whiteness and shine and, therefore, a ball ideally should exhibit good abrasion and cut resistance, be less easily contaminated and able to recover its original shine and whiteness after mud or the like is wiped off.

Conventionally, a paint for a golf ball is generally a urethane paint. For example, Japanese Patent Laying-Open No. 5-269221 uses a urethane clear paint including a hydroxy organic modified polysiloxane to allow maintaining the shock resistance of the coating and improve the ball's ability to slide for a long period of time. Specifically, the hydroxy organic modified polysiloxane used in the Japanese Patent Laying-Open No. 5-269221 is hydroxy polyester modified polysiloxane Byk-370 (from Byk Chemie Japan K.K.).

For cover materials, some techniques use a thermosetting polyurethane composition as described in U.S. Pat. No. 5,334,673, or a thermoplastic polyurethane elastomer as in U.S. Pat. Nos. 6,251,991 and 6,384,135.

SUMMARY OF THE INVENTION

In a golf ball using a urethane resin paint or the like, unevenness may occur in the paint during the painting process due to positive static electricity produced on the cover surface, which may cause deterioration in the appearance of the ball. Further, the spin performance of the golf ball may be adversely affected.

During the manufacture of a golf ball, a core is covered with a cover material and subsequently a surface treatment may be performed thereon as necessary before a painting process. At this moment, the surface of the golf ball is charged with positive ions because of static electricity. Painting under such conditions may produce an uneven surface due to the static electricity, causing asperity on the ball and adversely affecting its performance while its appearance is also impaired. The present invention provides a method of manufacturing a painted golf ball with reduced static electricity on the surface of the golf ball prior to the painting to allow even painting to produce a ball without asperity on the surface.

The present invention is a method of manufacturing a golf ball characterized by irradiating the surface of the golf ball, which is positively charged before painting, with negative ions directly before the painting. Preferably, the surface of the golf ball after the irradiation with negative ions and prior to the painting is negatively charged.

Particularly, according to the present invention, the surface of the golf ball after the irradiation with negative ions and prior to the painting is preferably charged at −0.1 to −40 kV. The outermost layer of the golf ball to be provided with paint is desirably a polyurethane elastomer composition.

As stated above, according to the present invention, the surface of a golf ball charged positively prior to painting may be irradiated with negative ions immediately before the painting to reduce the electrostatic force acting between the surface of the golf ball and the paint, thereby facilitating control of the application of the paint and reducing the asperity on the ball surface, as well as improving the appearance without adversely affecting the performance of the ball.

DESCRIPTION OF THE PREFERRED EMBODIMENT

Figure 1:
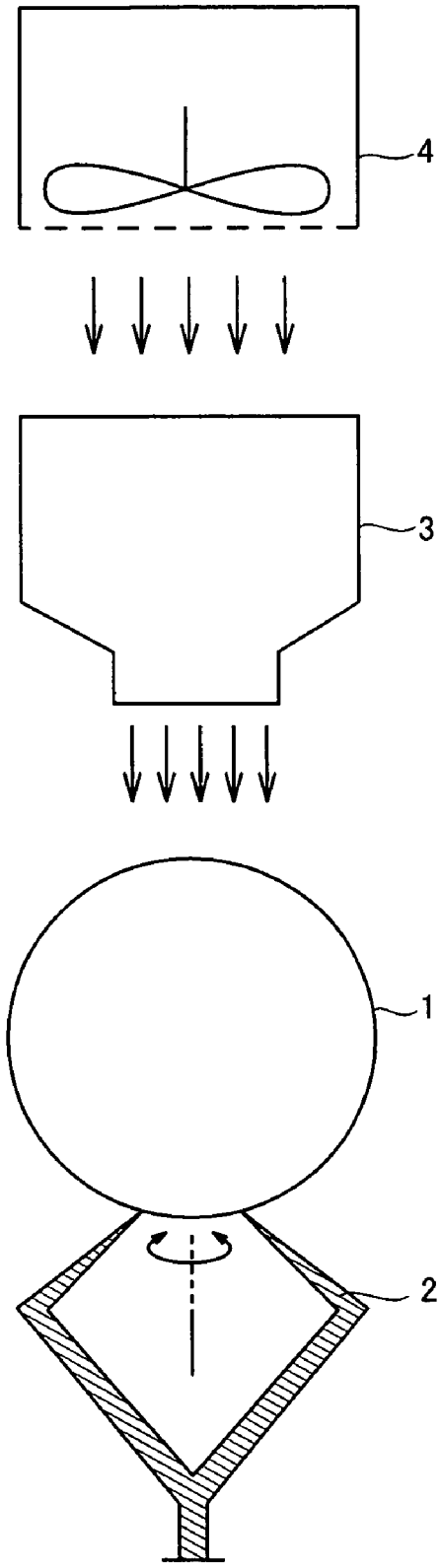
FIG. 1 is a schematic diagram of a negative ion irradiation apparatus.

The present invention is a method of manufacturing a golf ball including the step of irradiating the surface of the golf ball which is positively charged prior to painting with negative ions directly before the painting.

The painting process of a golf ball is performed after a pre-paint treatment, if necessary, on the surface of the golf ball body having a cover disposed around its core. This pretreatment may be performed by, for example, polishing or blasting, washing or similar processes.

<Negative Ion Irradiation>

According to the present invention, the surface of a cover, which is positively charged after the placement thereof or a pretreatment, may be irradiated with negative ions to reduce the charge of positive ions on the surface or, preferably, to charge the surface with negative ions. The painting may be then performed, resulting in significantly reduced asperity of the paint from the effect of static electricity on the ball surface.

The irradiation with negative ions in the present invention may be performed using a known negative ion generator. A negative ion generator as described in Japanese Patent Laying-Open No. 2002-65344, for example, may be used. Such a negative ion generator uses an incorporated transformer to increase the secondary voltage of 15V gradually to 3700V which is applied on a tip end of a negative ionization needle to generate negative ions. The negative ionization needle is generally disposed near the center of the outlet to allow concentrated emission of negative ions. The amount of negative ions generated may vary depending on the angle of the negative ion generator with respect to an object as well as the movement of air within the space, and may generate 1 to 6 million negative ions/$cm^3$ per second.

According to the present invention, the negative ion generator may be TIG-100A from Toshiba Corporation. Conventionally, negative ions may be either electrically generated, or generated by fragmentation of water, the former of which is employed in the above negative ion generator. It creates a very high electric field strength on a tip end of a needle-like discharge electrode to emit electrons into the air. The electrons are allowed to impinge on oxygen molecules in the air to negatively ionize the oxygen molecules. This negative ion generator generates approximately a hundred thousand ions/$cm^3$ measured at a position one meter away from the outlet and approximately a million ions/$cm^3$ measured at a position 30 cm from the outlet.

A method of irradiating a golf ball with negative ions will be described with reference to FIG. 1. In FIG. 1, a golf ball 1 mounted on prongs 2 is irradiated with a predetermined amount of negative ions from a negative ion generator 3 spaced apart with a predetermined distance from the ball. The amount of negative ions for the irradiation can be regulated by adjusting the amount of wind from a blower 4 disposed behind the negative ion generator and adjusting the distance between the generator and the ball as well as the duration of irradiation. Prongs 2 may be driven to rotate the golf ball to allow the irradiation of the entire surface of the golf ball with negative ions, such that the amount of charge with positive ions on the surface, which lies at 10 to 30 kv before the irradiation, can be reduced or, preferably, the surface can be charged with negative ions.

The amount of charge of negative ions may preferably lie at −40 kv or smaller and preferably at −30 kv or smaller and particularly at −25 kv or smaller.

<Pre-Paint Treatment>

During the molding of the golf ball body, dimples are formed on the surface and, for example, a stamp may be marked as necessary. Before a paint layer is applied on the golf ball body, it is desirable to appropriately polish the surface of the ball body to improve the adhesion of the paint thereto.

The polishing may be performed by polishing the surface of the ball body using a grind stone or a polishing cloth, where barreling may be employed for reasons of productivity and uniform polishing. Barreling involves placing a ball body and a grind stone in a barreling apparatus and rotating them to effect the polishing. Blasting may also be employed in which non-metal particles, such as quartz grains, or metal particles may be sprayed onto the surface of a golf ball body at high speeds to roughen the surface.

In addition, it is preferable to wash the surface of the ball body to remove resin powders or the like produced during the polishing or blasting on the surface. The washing may preferably use water, which is safe and easy to handle and ecologically advantageous, although organic solvents or chemical agents may also be used.

<Painting>

Paints used in the present invention include urethane resin, epoxy resin, acrylic resin, polyester resin paints, where urethane resin paint is preferable, where selection is desirably based on the adhesion of the paints on the underlying layer. A urethane resin paint may be a two-part urethane paint made of a base and a hardener. The base of the urethane resin paint is predominantly composed of a polyol component. The polyol component includes a particular urethane polyol, as listed below.

The urethane polyol can be synthesized by reaction of a polyisocyanate compound and polyol. Any polyisocyanate compound having two or more isoscyanate groups may be used for the synthesis and may include, but not limited to, hexamethylene diisocyanate (HDI), xylylene diisocyanate (XDI), hydrogenated xylylene diisocyanate ($H_6$XDI), isophorone diisocyanate (IPDI), tetramethyl xylylene diisocyanate (TMXDI), hydrogenated diphenylmethane diisocyanate ($H_{12}$MDI) or the like, which are made of aliphatic, alicyclic, aromatic, aromatic-aliphatic diisocyanate compounds. For reasons of weather resistance, an anti-yellowing polyisocyanate (an aliphatic, alicylic polyisocyanate) is preferably used.

Any polyol having a plurality of hydroxyl groups may be used for manufacturing the urethane polyol and may be a low or high molecular weight compound. Low molecular weight polyols include, for example, diols such as ethylene glycol, diethylene glycol, triethylene glycol, butylene glycol, 1,3-butanediol, 1,4-butanediol, neopentylglycol, 1,6-hexanediol; or triols such as glycerin, trimethylolpropane, hexanetriol and the like.

High molecular polyols include a polyether polyol that can be provided by reaction of an initiator having an active hydrogen agent with alkylene oxide; a condensation-based polyester polyol provided by dehydration condensation of a dibasic acid such as adipic acid and a glycol or triol; a lactone-based polyester polyol provided by ring-opening polymerization of a lactam such as ϵ-caprolactam; a polycarbonate diol synthesized from a cyclic diol; and polymer polyols such as an acrylic polyol made by introducing a hydroxil group as appropriate into an acrylic-based copolymer. The polyether polyol may include polyethylene glycol, polypropylene glycol, polytetramethylene glycol and the like, and the condensation-based polyester polyol may include polyethylene adipate, and the lactone-based polyester polyol may include poly-ϵ-caprolactone.

The paint may include components as mentioned above as well as a variety of additives, diluents and the like. Examples of additives include ultraviolet absorbent, photo-stabilizer, filler pigment and fluorescer or fluorescent brightener. The amount of such additives ranges from 0.1 to 10% by weight relative to the solid portion of the paint.

Fluorescent brighteners mixed into the paint include generally known ones typically for use in golf balls. Specific examples include 2,5-bis(5-t-butyl-2-benzoxazolyl) thiophene (commercially available from Ciba-Geigy Japan Ltd. as Ubitex OB), or 7-(2h-naphthol (1,2-d)-triazole-2-yl)-3-phenyl-coumarin (commercially available from Sandoz Chemicals Corporation as "Leucopure EGM") or the like. The flourescent brighteners may be such as a biazoline derivative (commercially available from Mobay Chemical Corporation as "Phorwhite K-2002") and an oxazole-based one (commercially available from Sumitomo Chemicals Co., Ltd. as "Whiteflour HCS", "Whiteflour-PCS", "Whiteflour-B"). The amount thereof may range from 0.005 to 1.0% by weight relative to the solid portion of the coating.

Diluents mixed into the paint may include water, alcohols such as isopropyl alcohol, aromatics such as toluene, hydrocarbons such as hexane, esters such as ethyl acetate, ketones such as methyl ethyl ketone. The amount of the diluent may range from 5 to 50% by weight, although it is not specifically limited thereto.

The method of painting is not particularly limited. After a base is mixed with a hardener, known methods may be used to apply a two-part mixed paint using an air spray gun, electrostatic painting or the like, onto a golf ball that has undergone a surface treatment such as washing. When the painting is performed by a spray gun, small amounts of a base and a hardener may be mixed for use, or two liquids may be continuously mixed at a constant proportion using a two-liquid constant proportion pump to allow the two liquids to pass through a line mixer, such as a static mixer, via a paint transfer path directly before the spray gun, or an air spray system with a mechanism for controlling the mixing proportion may be used.

In a painted golf ball of the present invention, the paint layer may have a single-layer structure or a multi-layer structure with two or more layers, where having a single-layer structure is preferable to simplify the painting process.

In a painted golf ball of the present invention, the paint layer desirably has a thickness of 6-25 μm, and preferably 8-20 μm. The paint layer with a thickness below 6 μm is more prone to wear out when used continuously, whereas at a thickness over 25 μm, the effect of the dimples is too small, causing a decrease in the flight performance of the golf ball.

<Golf Ball>

The structure of the golf ball of the present invention is not limited. For example, it may be a so-called solid golf ball with an inner core layer covered with an outer core layer and a cover, or a so-called thread-wound golf ball with a core covered with a wound thread layer and a cover, or it may be a one-piece golf ball.

The golf ball of the present invention desirably exhibits a deformation, when measured beginning with an initial load of 98N applied thereto and ending with a final load of 1275N, of 2.50-3.10 mm and preferably 2.55-3.00 mm, and more preferably 2.60-2.95 mm. A deformation below 2.50 mm causes hard and unpleasant feel, whereas at a deformation over 3.10 mm, a ball is too soft resulting in heavy and unpleasant feel.

The golf ball of the present invention is formed in accordance with the golf ball regulations with a diameter of 42.67 mm or more (preferably 42.67-43 mm), and a weight of 45.93 g or below.

<Core Compositions>

The core of the golf ball of the present invention is composed of a single layer or a plurality of layers. The term "core" as used herein includes an inner core layer, an outer core layer and an intermediate layer. An inner core layer may be a solid or liquid core. For example, a solid core may be fabricated by hot-pressing a rubber composition containing a base rubber, a co-crosslinking agent, an organic peroxide, a filler and the like. The base rubber may include a natural and/or synthetic rubber as is conventionally used, where a so-called high cis-polybutadiene rubber having cis-1,4 bond in at least 40% or more and preferably 80% or more thereof is particularly preferable. The polybutadiene rubber may be mixed with natural rubber, polyisoprene rubber, styrene polybutadiene rubber, EPDM or the like as desired.

The co-crosslinking agent may include a monovalent or bivalent metal salt such as a zinc or magnesium salt of an α,β-unsaturated carboxylic acid with 3 to 8 carbon atoms such as acrylic acid or methacrylic acid, or a blend thereof with acrylic ester or methacrylic ester, where zinc acrylate is suitable since it provides high resilience. The amount is 10-50 parts and preferably 20-40 parts by weight per 100 parts by weight of the base rubber. An amount higher than 50 parts by weight produces an excessively hard ball resulting in unpleasant feel, whereas at an amount below 10 parts by weight, the amount of organic peroxide must be increased to provide a suitable hardness, resulting in poor resilience and reduced distance.

The organic peroxide may include, for example: dicumyl peroxide; 1,1-bis(t-butyl peroxy)-3,3,5-trimethyl cyclohexane; 2,5-dimethyl-2,5-di(t-butyl peroxy)hexane; di-t-butyl peroxide and the like, where dicumyl peroxide is suitable. The amount is 0.3-3 parts and preferably 0.4-2 parts by weight per 100 parts by weight of the base rubber. An amount below 0.3 parts by weight produces an excessively soft ball, resulting in poor resilience and decreased distance. At an amount higher than 3 parts by weight, the amount of the metal salt of α,β-unsaturated carboxylic acid must be decreased to provide a suitable hardness, resulting in poor resilience and decreased distance.

The filler may be any filler that is typically mixed into the core of a solid golf ball and may include e.g. an inorganic filler, or more specifically: zinc oxide, barium sulfate, calcium carbonate, magnesium oxide or the like. It may be used together with a high gravity metal filler such as tungsten powder, a molybdenum powder or a mixture thereof. The amount is 2 to 50 parts and preferably 3 to 35 parts by weight per 100 parts by weight of the base rubber. An amount less than 2 parts by weight may cause difficulties in regulating the weight, whereas an amount higher than 50 parts by weight results in excessively small weight percentage of the rubber, which provides insufficient resilience of the ball.

Further, the core of the golf ball of the present invention may be appropriately mixed with an organic sulfur compound, an anti-oxidant or a peptizer, or other components that can be commonly used in manufacture of the core of a solid golf ball. The amount of anti-oxidant is preferably 0.1-1.0 parts by weight per 100 parts by weight of the base rubber, and the amount of peptizer is preferably 0.1-5.0 parts by weight.

The core of the golf ball of the present invention may be fabricated by blending and mixing and kneading rubber compositions as listed above and cure-molding them in a mold. Conditions for this process are not particularly limited, although typically it is performed at 130-180° C. and at a pressure of 2.9-11.8 MPa for 10-50 min.

<Outer Core Layer Composition>

The present invention may include a plurality of layers i.e. an inner core layer and an outer core layer disposed around it. The outer core layer, which is adjacent to the cover, may be formed of rubber compositions for the core as described above, or may be formed of a base resin including a thermoplastic resin, particularly an ionomer resin which is commonly used for the cover of a golf ball.

Particularly, such ionomer resin may include ionomer resins in which part of the carboxylic acid in the copolymer of α-olefin and an α,β-unsaturated carboxylic acid with 3 to 8 carbon atoms is neutralized by a metal ion, or in which at least part of the carboxylic acid in the ternary copolymer of α-olefin, an α,β-unsaturated carboxylic acid having 3 to 8 carbon atoms and an α,β-unsaturated carboxylic ester is neutralized by a metal ion, or a mixture thereof. The α-olefin in the ionomer resin may preferably be ethylene or propylene, and the α,β-unsaturated carboxylic acid may include, for example, acrylic acid, methacrylic acid, fumaric acid, maleic acid, crotonic acid or the like, where acrylic acid, methacrylic acid and the like are particularly preferable. The α,β-unsaturated carboxylic ester may include, for example, methyl, ethyl, propyl, n-butyl, isobutyl ester and the like of acrylate, methacrylate, fumaric acid, maleic acid or the like, where acrylate and methacrylate are particularly preferable. The neutralizing metal ion may include an alkali metal ion such as Na ion, K ion, Li ion or the like; a bivalent metal ion such as Zn ion, Ca ion, Mg ion or the like; a trivalent metal ion such as Al ion, Nd ion or the like; and a mixture thereof, where Na ion, Zn ion, Li ion or the like are commonly used for reasons of resilience and durability.

Examples of the ionomer resin may include, but not limited to, Hi-milan 1555, Hi-milan 1557, Hi-milan 1601, Hi-milan 1605, Hi-milan 1652, Hi-milan 1702, Hi-milan 1705, Hi-milan 1706, Hi-milan 1707, Hi-milan 1855, Hi-milan 1856, Hi-milan AM 7316 (from Mitsui-DuPont Polychemical Co., Ltd.), Surlyn 8945, Surlyn 9945, Surlyn 6320, Surlyn 8320, Surlyn AD8511, Surlyn AD8512, AD8542 (from DuPont Co. Ltd.), Iotek 7010, Iotek 8000 (from Exxon Mobil Corporation) or the like. Each of the ionomers listed above may be used alone, or two or more thereof may be mixed.

Further examples of the preferable materials for the outer core layer of the present invention include a combination of the above ionomer resin and one or more of a thermoplastic elastomer or a diene-based block copolymer. Examples of the thermoplastic elastomer may include a thermoplastic polyamide-based elastomer as commercially available from Atofina Japan K. K. under the trade name of "Pebax" (for example, "Pebax 2533"), a thermoplastic polyester-based elastomer commercially available from Toray-Dupont Co., Ltd. under the trade name of Hytrel (for example, "Hytrel 3548", "Hytrel 4047"), a thermoplastic polyurethane-based elastomer as commercially available from Takeda Badische Urethane Industries, Ltd. under the trade name of "Elastollan" (for example, Elastollan ET 880") or the like.

A diene-based block copolymer as mentioned above has double bonds derived from a conjugated diene compound of a block copolymer or a partially hydrogenated block copolymer. The block copolymer that provides the base is composed of a polymer block A predominantly made of at least one type of vinyl aromatic compound and a polymer block B predominantly made of at least one type of conjugated diene compound. The partially hydrogenated block copolymer can be provided by hydrogenating the above block copolymer. The vinyl aromatic compound constituting the block copolymer may be one or more selected from, for example, styrene, α-methyl styrene, vinyl toluene, p-t-butyl styrene, 1,1-diphenyl styrene and the like, where styrene is preferable.

The conjugated diene compound may be one or more selected from, for example, butadiene, isoprene, 1,3-pentadiene, 2,3-dimethyl-1,3-butadiene and the like, where butadiene, isoprene and a combination thereof are preferable. Examples of preferable diene-based block copolymers include a block copolymer with an SBS (styrene-butadiene-styrene) structure having a polybutadiene block containing an epoxy group, or a block copolymer with an SIS (styrene-isoprene-styrene) structure having a polyisoprene block containing an epoxy group, or the like. Examples of the diene-based block copolymers may include those commercially available from Daicel Chemical Industries, Ltd. under the trade name of "Epofriend" (for example "Epofriend A1010"), or from Kuraray Co., Ltd. under the trade name of "Septon" (for example, "Septon HG-252" and the like).

The thermoplastic elastomers or the diene-based block copolymers may be used alone. They may also be mixed with an ionomer resin in 1-60 parts and preferably 1-35 parts by weight per 100 parts by weight of the ionomer resin. An amount less than 1 part by weight results in insufficient effect from such mixing, such as improvement in the feel, whereas an amount over 60 parts by weight produces excessively soft layers except the innermost layer of the core, resulting in a decrease in resilience, and adversely affecting compatibility with the ionomer resin, resulting in decreased durability.

When the outer core layer is formed of a rubber composition, a rubber composition for the innermost layer is first mixed and kneaded and heat-pressed in a mold at 130-180° C. for 10 to 40 min to fabricate a spheric innermost core. Subsequently, a rubber composition for the outer core layer is mixed and kneaded and placed concentrically on the innermost core layer and heat-pressed in a mold at 160-180° C. for 10 to 20 min to provide a dual-layer core having the innermost core layer covered with the outer core layer. When the layers other than the innermost layer are formed of a thermoplastic resin, the resin composition may be injection-molded directly on the innermost core layer to provide a dual-layer core. The resulting core may preferably be buffed on its surface in order to improve the contact with a cover that is to surround it.

<Core Property>

The core of the golf ball of the present invention has a diameter ranging from 40.8 to 42.2 mm, preferably from 40.8 to 42.0 mm. A core with a diameter smaller than 40.8 mm means an excessively thick cover which causes decrease in resilience, whereas a diameter of the core greater than 42.2 mm results in a cover with insufficient thickness and thus a cover that is insufficiently effective, while making the molding difficult.

The core of the golf ball of the present invention has a deformation, measured beginning with an initial load of 98N applied thereto and ending with a final load of 1275N, of 2.50-3.20 mm, preferably 2.60-3.10 mm. A deformation less than 2.50 mm produces hard and unpleasant feel, whereas a deformation over 3.20 mm produces an excessively soft ball, resulting in a heavy and unpleasant feel.

Generally, the greater the difference in hardness between the surface and the center of the core, the larger the launch angle, which is an important factor in flight performance, reducing the amount of spin and increasing the distance. The core of the golf ball of the present invention may desirably have a surface hardness measured by the Shore D hardness that is greater than the center hardness, for example larger than 10. Such a difference in hardness allows achieving higher launch angle and smaller amount of spin, providing increased distance. Further, the impact force imparted to the ball becomes smaller, which facilitates providing soft and good feel. A difference in hardness that is excessively large results in a decrease in durability such that the maximum of the difference in hardness should preferably be 30 or smaller. A center hardness smaller than 10 results in an excessively soft ball with poor resilience. A center hardness greater than 30 produces a ball that is excessively hard with unpleasant feel when struck, and decreases the launch angle and increases the amount of spin, resulting in decreased flight performance. As used in the present specification, the center hardness of the core generally means the hardness measured at the midpoint of a cut surface when the core is cut into two equal parts.

The core of the golf ball of the present invention has a surface hardness measured by the shore D hardness from 45 to 70, and preferably from 50 to 62. A surface hardness smaller than 45 produces an excessively soft ball resulting in decreased resilience and reduced launch angle, also increasing the amount of spin and reducing the flight performance. A surface hardness greater than 70 results in a ball that is excessively hard with unpleasant feel when struck. It should be noted that the present invention is not limited to a core having a difference in hardness between its surface and center.

The core used for the golf ball of the present invention may be of a single-layer structure or of a multi-layer structure from two or more layers, where a single-structure core (i.e. a two-piece golf ball) is preferable for reasons of productivity. In the case of a core of a multi-layer structure, the surface hardness of the core means the hardness of the outer surface of the multi-layer core. Further, in the case of a core of a multi-layer structure, the innermost layer is preferably composed of a base rubber including a rubber composition containing cis-1, 4-polybutadiene as described above, although the other layers may have a base including a resin such as a thermoplastic resin.

<Cover>

A cover is placed upon the core, the thread rubber layer or the outer core layer. The cover used for the golf ball of the present invention may use materials used for the outer core layer, particularly (a) a thermoplastic polyurethane-based elastomer having an alicyclic diisocyanate as a constituent or (b) a mixture of a thermoplastic polyurethane-based elastomer having an alicyclic diisocyanate as a constituent with a thermoplastic polyamide-based elastomer is preferably included as a base resin. In this case, the loading of the component (a) or (b) is 50% or more by weight relative to the entire cover material, preferably 70% or more by weight, more preferably 90% or more by weight, and most preferably 100% by weight.

The thermoplastic polyurethane-based elastomer generally contains a polyurethane structure as a hard segment and contains polyester or polyether as a soft segment. The polyurethane structure generally contains diisocyanate and an amine-based hardener, for example. In the thermoplastic polyurethane-based elastomer having an alicyclic diisocyanate as a constituent, the constituent diisocyanate is an alicyclic diisocyanate.

The examples of the alicyclic diisocyanate include one or a combination of two or more selected from the group consisting of: 4,4'-dicyclohexyl methane diisocyanate ($H_{12}MDI$), which is a hydrogenated 4,4'-diphenyl methane diisocyanate (MDI); 1,3-bis(isocyanato methyl) cyclohexane ($H_6XDI$), which is a hydrogenated xylylene diisocyanate (XDI); isophorone diisocyanate (IPDI); and trans-1,4-cyclohexane diisocyanate (CHDI), where $H_{12}MDI$ is suitable for reasons of versatility and workability. Exemplary thermoplastic polyurethane-based elastomers using $H_{12}MDI$ mentioned above include "Ellastollan XNY 90A (trade name)", "Ellastollan XNY97A (trade name)", "Ellastollan XNY585 (trade name)" and the like commercially available from BASF Polyurethane Elastomers Ltd.

Generally, diisocyanates can be categorized as alicyclic diisocyanates as described above as well as aliphatic and aromatic diisocyanates. The thermoplastic polyurethane-based elastomer preferably uses a diisocyanate without a double bond in the skeleton within a molecule i.e. aliphatic diisocyanate and alicyclic diisocyanate for reasons of discoloration (yellowing) resistance. Moreover, for reasons of cut resistance or the like, thermoplastic polyurethane-based elastomers using alicyclic diisocyanate and, further, aromatic diisocyanate are preferable, which exhibit high mechanical strength. A more preferable thermoplastic polyurethane-based elastomer for the cover of a golf ball of the present invention uses alicyclic diisocyanate for reasons of discoloring as well as cut resistances.

The thermoplastic polyamide-based elastomer generally contains polyamide as a hard segment and contains polyether or polyester as a soft segment. The thermoplastic polyamide-based elastomer used for the cover of the golf ball of the present invention may be a thermoplastic polyether polyamide-based elastomer or a thermoplastic polyester polyamide-based elastomer, where a thermoplastic polyether polyamide-based elastomer is suitably used. An example of such a thermoplastic polyether polyamide-based elastomer is "Pebax 5533SN00 (trade name)" commercially available from Elf Atochem Japan.

Desirably, the proportion of thermoplastic polyurethane-based elastomer to thermoplastic polyamide-based elastomer blended together ranges from 100:0 to 70:30, preferably 98:2 to 80:20, and more preferably 95:5 to 90:10. More than 30% by weight of thermoplastic polyamide-based elastomer provides poor cut resistance.

A golf ball of the present invention generally uses a cover material including a base resin i.e. such thermoplastic elastomers as discussed above, as well as polystyrene-based, polyester-based, polyolefin-based thermoplastic elastomers or a nylon resin.

In a golf ball of the present invention, the cover material may contain resin components as mentioned above as well as pigment such as titanium dioxide, dispersant, anti-oxidant, ultraviolet absorbent, photo-stabilizer, fluoroscer, fluorescent brightener and other additives as needed to a degree that will not compromise the desired characteristics of the cover of a golf ball, where the loading of pigment is usually preferred to be 0.1-5 parts by weight per 100 parts by weight of the base resin for the cover.

The placement of the cover may utilize techniques already known. A cover composition may be pre-molded into a spherical half shell. Two such half shells may be used to surround the core, where press-molding may be performed at 160-200° C. for 1 to 10 min, or the cover composition may be injection-molded directly on the core to surround it. Press-molding is suitably used to provide a ball with sufficient sphericity.

The thickness of the cover is typically 3.0 mm or smaller, and preferably 0.3-1.5 mm and more preferably 0.5-0.9 mm. A thickness of the cover over 3.0 mm, which means excessive thickness, causes a decrease in resilience which results in decreased distance, while a thickness of the cover that is too small provides a cover that is insufficiently effective, causes difficulties in molding which results in a ball without sufficient sphericity.

The cover of the golf ball of the present invention desirably has a shore D hardness of 35-55, preferably 40-50, and more preferably 44-49. A cover hardness below 35 reduces resilience, whereas a cover hardness over 55 causes hard and unpleasant feel. As used in the present specification, the cover hardness means a hardness measured using a heat-pressed sheet fabricated from a cover composition.

EXAMPLES

The present invention will now be described in further detail with reference to examples as provided below. It should be noted, however, that the present invention is not limited to these examples.

<Fabrication of Inner and Outer Core Layers>

(1) Inner Core Layer

An inner core layer rubber composition having formulations as shown in Table 1 was mixed and kneaded and heat-pressed in a mold under curing conditions as shown in the table to provide an inner core layer.

(2) Outer Core Layer

An outer core layer having the core formulation 3 shown in Table 1 was fabricated by mixing and kneading the outer core layer rubber composition and pre-molding half-cured half shells and covering concentrically the inner core layer therewith, before heat-pressing it within a mold under curing conditions as shown in the table to provide a two-layer core.

An outer core layer having the core formulation 2 shown in the Table 1 was fabricated by mixing and kneading the outer core layer elastomer composition and concentrically injection-molding it on the inner core layer to provide a two-layer core.

The diameter, compressive deformation, center hardness (a) and surface hardness (b) of the resulting two-layer cores were measured, the results of which are shown in the table. From these results, the difference in hardness (b-a) between the surface and center of the core (the inner and outer core layers) was calculated, as shown in the table.

TABLE 1

| <Core Formulation> | 1 | 2 | 3 |
|---|---|---|---|
| [Inner Core Layer] | | | |
| BR-18(Note 1) | 100 | 100 | 100 |
| Zinc Acrylate | 33 | 33 | 33 |
| Zinc Oxide | 12 | 14 | 7.5 |
| Diphenyl Disulfide(Note 2) | 0.5 | 0.5 | 0.5 |
| Dicumyl Peroxide(Note 3) | 1 | 1 | 0.8 |
| Curing Condition | 170° C. × 15 min. | | |
| [Outer Core Layer] | | | |
| BR-18(Note1) | — | — | 100 |
| Zinc Acrylate | | — | 37 |
| Zinc Oxide | | — | 11 |
| Diphenyl Disulfide(Note 2) | | — | 0.5 |
| Dicumyl Peroxide(Note 3) | | — | 0.7 |
| Hi-milan 1605(Note 4) | | 50 | — |
| Hi-milan 1706(Note 5) | | 50 | — |
| Curing Condition | — | — | 170° C. × 15 min. |
| Core Diameter | 41.2 | 41.2 | 41.2 |
| Core Center Hardness; a (Shore D hardness) | 33 | 33 | 33 |
| Core Surface Hardness; b (Shore D hardness) | 52 | 70 | 55 |
| Difference in Hardness (b − a) | 19 | 37 | 22 |
| Core Compressive Deformation (mm) | 2.95 | 2.7 | 2.8 |

(Note 1)High cis-polybutadiene rubber commercially available from JSR Corporation under the trade name of "BR-18" (cis-1,4-polybutadiene content = 96%).
(Note 2)Diphenyl disulfide from Sumitomo Seika Chemicals Co., Ltd.
(Note 3)Dicumyl peroxide from NOF Corporation.
(Note 4)Hi-milan 1605: Na ion-neutralized ionomer from Mitsui-DuPont Polychemical Co., Ltd.
(Note 5)Hi-milan 1706: Zn ion-neutralized ionomer from Mitsui DuPont Polychemical Co., Ltd.

<Preparation of Cover Composition>

The cover formulation shown in Table 2 was mixed using a biaxial kneading extruder to provide a cover composition in the shape of a pellet. Extruding conditions were: a screw diameter of 45 mm, a screw revolution of 200 rpm, and a screw L/D of 35, and the mixture was heated to 200-260° C. as measured at a die of the extruder. The resulting heat-pressed sheet of the cover composition with a thickness of 2 mm was stored at 23° C. for two weeks. Three or more such sheets were placed upon each other and the hardness was measured using a spring type hardness meter of shore D type as specified by ASTM-2240-68, as shown in Table 2.

The cover compositions provided by Examples 1 to 5 and Comparative Example 1 were injection-molded into a half spheric shell, and the core described above was surrounded by two such shells and heat-pressed within a mold at 170° C. for 2 min to form it to provide a cover thickness shown in Table 2. Subsequently, the molded product was removed from the mold and trimmed.

TABLE 2

| Cover Formulations | α | β |
|---|---|---|
| Elastollan XNY97A(Note 1) | 100 | 80 |
| Pebax 5533SNOO(Note 2) | — | 20 |
| Titanium Dioxide | 4 | 4 |
| Cover Thickness (mm) | 0.8 | 0.8 |
| Cover Hardness (ShoreD Hardness) | 46 | 48 |

(Note 1)Elastollan XNY97A: from BASF Japan Ltd. 4,4'-dicyclohexyl methane diisocyanate-based polyurethane elastomer.
(Note 2)Pebax 5533SNOO: from Atofina Japan K.K. Thermoplastic polyamide elastomer.

<Surface Treatment of Cover>

The cover surface was treated utilizing a method as disclosed in Japanese Patent No. 3372459. That is, a grinder having a fixing container and a rotating dish rotatably disposed in the fixing container was loaded with a golf ball, a grindstone and water. The rotating dish, which has a wall extending from the bottom of the grinder to the vicinity of the upper end of the fixing container, was spun to allow the ball to be rotated in a whirling manner on the rotating dish to trim the ball and simultaneously roughen the ball's surface.

<Ionization >

A negative ion irradiation apparatus schematically shown in FIG. 1 irradiated the golf ball with negative ions. In FIG. 1, negative ion generator 3 spaced apart with a predetermined distance from a golf ball 1 mounted on prongs 2 emit a predetermined amount of negative ions, where the amount of emitted negative ions could be regulated by adjusting the amount of wind from blower 4 disposed behind the negative ion generator, and adjusting the distance between the negative ion generator and the golf ball, and the duration of irradiation. The prongs were driven and the golf ball was rotated such that the entire surface of the golf ball was irradiated with negative ions.

The surface charges of the golf ball were measured by means of a digital electrostatic meter (KSD-0103 from Kasuga Denki Inc.).

TABLE 3

| | Example 1 | Example 2 | Example 3 | Example 4 | Example 5 | Example 6 | Example 7 | Comparative Example 1 |
|---|---|---|---|---|---|---|---|---|
| Core Formulation | 1 | 1 | 1 | 2 | 3 | 1 | 1 | 1 |
| Cover Formulation | α | β | α | α | α | α | α | α |
| Deformation (mm) at 98-1274N Load | 2.9 | 2.85 | 2.9 | 2.65 | 2.75 | 2.9 | 2.9 | 2.9 |
| Distance (cm) from Negative Ion Generator | 3 | 5 | 10 | 10 | 10 | 20 | 25 | No irradiation |
| Duration of Irradiation (sec.) | 1 | 1 | 1 | 1 | 1 | 1 | 1 | 1 |
| Surface Charge Before Irradiation (kV) | 20 | 20 | 20 | 20 | 20 | 20 | 20 | 20 |
| Surface Charge After Irradiation (kV) | −10 | −7 | −3.5 | −3.5 | −3.5 | −0.7 | −0.1 | — |
| Appearance (visual inspection) | A | A | B | B | B | B | C | D |

<Painting>

A two-part urethane resin-based paint composed of a base and a hardener was used. Specifically, the base was a mixture of PTMG 650 (polyoxytetramethylene glycol with a molecular weight of 650 from Hodogaya Chemical Co., Ltd.) in 116 parts by mass and 1,2,6-hexanetriol in 16 parts by mass allowed to dissolve in a solvent (toluene and methyl ethyl ketone) in 120 parts by mass to which dibutyl tin dilaurylate is added. The hardener was hexamethylene diisocyanate (from Bayer). The thickness of the paint after drying was 10 μm.

<Evaluation of Golf Ball>

The paint was applied to the surface of a golf ball to provide a ball with a diameter of 42.8 mm and a weight of 45.4 g. The resulting golf ball was tested as follows:

(1) Compressive Deformation

Deformation (mm) was measured beginning with an initial load of 98N applied to a core or a golf ball and ending with a final load of 1275N.

(2) Shore D Hardness (i) The shore D hardness measured on the surface of the core was used as the surface hardness of the core. The shore D hardness measured at the midpoint of a cut surface produced by cutting the core into two equal parts was used as the center hardness of the core. The shore D hardness was measured using a spring type hardness meter (shore D type) as specified by ASTM-D2240.

(ii) Cover hardness: Heat-press molded sheets of the cover compositions with a thickness of 2 mm were stored at 23° C. for two weeks. Three or more such sheets were laid upon each other and measurement was conducted using a spring type hardness meter (shore D type) as specified by ASTM-D2240.

(3) Appearance

The appearance of the ball after painting was observed visually and evaluated according to the following criteria:

A: shiny and good appearance

B: exhibiting little asperity

C: exhibiting a little asperity

D: no shine

The evaluation shown in Table 3 demonstrates that the Examples 1 to 7, where irradiation with negative ions turned the charge of the surface of the respective golf balls to negative, provided improved appearance over Comparative Example 1, which had no irradiation with negative ions.

Thus, according to the present invention, after surface treatment on a golf ball and prior to painting, the surface of the golf ball charged with positive ions due to static electricity can be irradiated with negative ions to reduce the static electricity, thereby allowing even painting to provide a painted golf ball without asperity thereon.

What is claimed is:

1. A method of manufacturing a golf ball including the steps of:

providing a golf ball having a positively charged surface;

irradiating the surface of the golf ball, with negative ions; and applying at least one layer of paint to the surface of the ball immediately after the step of irradiating; and wherein the surface of the golf ball after the irradiation with negative ions and prior to applying at least one layer of paint is charged at −0.1 to −40 kV.

2. The method according to claim 1 wherein an outermost layer of the painted golf ball is a polyurethane elastomer composition.

3. The method according to claim 1 wherein the negative ions include negatively ionized oxygen molecules.

4. The method according to claim 3, and further including the step of producing the negatively ionized oxygen molecules through impingement of electrons in air.

5. The method according to claim 1, and further including the step of generating a flow of air to carry the negative ions to the surface of the golf ball.

6. A method of manufacturing a golf ball including the steps of:

providing a golf ball having a positively charged surface;

irradiating the surface of the golf ball, with negative ions;

applying at least one layer of paint to the surface of the ball immediately after the step of irradiating; and using a blower to generate a flow of air to carry the negative ions to the surface of the golf ball.

7. The method according to claim 6 wherein the surface of the golf ball after the irradiation with negative ions and prior to applying at least one layer of paint is negatively charged.

8. The method according to claim 7 wherein the surface of the golf ball after the irradiation with negative ions and prior to applying at least one layer of paint is charged at −0.1 to −40 kV.

9. The method according to one of claims 6-8 wherein an outermost layer of the painted golf ball is a polyurethane elastomer composition.

10. The method according to one of claims 6-8 wherein the negative ions include negatively ionized oxygen molecules.

11. The method according to claim 10, and further including the step of producing the negatively ionized oxygen molecules through impingement of electrons in air.

* * * * *